US010704174B2

(12) United States Patent
Aurich et al.

(10) Patent No.: US 10,704,174 B2
(45) Date of Patent: Jul. 7, 2020

(54) DEVICE FOR APPLYING A FOAMED TREATING MATERIAL UNDER PRESSURE TO A TRAVELING SHEET OF TEXTILE YARN

(71) Applicant: Gaston System, Inc., Stanley, NC (US)

(72) Inventors: Christoph W. Aurich, Clemson, SC (US); James E. Talbert, Jr., Lancaster, SC (US); Jerry D. Morgan, Gastonia, NC (US)

(73) Assignee: GASTON SYSTEMS, INC., Stanley, NC (US)

( * ) Notice: Subject to any disclaimer, the term of this patent is extended or adjusted under 35 U.S.C. 154(b) by 393 days.

(21) Appl. No.: 15/805,856

(22) Filed: Nov. 7, 2017

(65) Prior Publication Data

US 2019/0136430 A1 May 9, 2019

(51) Int. Cl.

| | |
|---|---|
| ***B05C 5/02*** | (2006.01) |
| ***B65H 51/12*** | (2006.01) |
| ***B65H 57/14*** | (2006.01) |
| ***D06B 1/00*** | (2006.01) |
| ***D06B 1/08*** | (2006.01) |

(Continued)

(52) U.S. Cl.

CPC ..... *D06B 1/00* (2013.01); *B05C 5/0245* (2013.01); *B05C 5/0254* (2013.01); *B65H 51/12* (2013.01); *B65H 57/14* (2013.01); *D06B 1/08* (2013.01); *D06B 5/08* (2013.01); *B65H 2701/31* (2013.01); *D06B 23/021* (2013.01)

(58) Field of Classification Search

CPC ..... B05C 5/0245; B05C 5/0254; B65H 51/12; B65H 57/14; B65H 2701/31; D06B 1/00; D06B 1/08; D06B 5/08; D06B 23/021

USPC ..... 68/200

See application file for complete search history.

(56) References Cited

U.S. PATENT DOCUMENTS

| | | | |
|---|---|---|---|
| 4,512,279 | A | 4/1985 | Damrau |
| 4,943,451 | A | 7/1990 | Zimmer |
| 5,008,131 | A | 4/1991 | Bakhshi |

(Continued)

FOREIGN PATENT DOCUMENTS

| | | | |
|---|---|---|---|
| CN | 208917497 | U | 5/2019 |

OTHER PUBLICATIONS

"International Search Report" and "Written Opinion" of the International Search Authority (ISA/US) in Gaston Systems, Inc., International Patent Application Serial No. PCT/US2019/061334, dated Feb. 28, 2020 (6 pages).

*Primary Examiner* — Levon J Shahinian

(74) *Attorney, Agent, or Firm* — Tillman Wright, PLLC; James D. Wright; David R. Higgins

(57) ABSTRACT

A device for applying a foamed treating material under pressure to a traveling sheet of relatively incompressible textile yarns. A foam applicator unit has a nozzle with a foam dispensing slot facing across one side of the traveling sheet of yarns. A drive roll faces the other side of the traveling sheet of yarns in tangential alignment with the foam dispensing slot. The roll has a resiliently compressible, soft rubber outer layer, which compresses to conform with the surface of the relatively incompressible yarns and presses the traveling sheet of yarns against the applicator surfaces leading to and away from the slot to prevent escape of foam and to prevent passage of foam between yarns to maintain uniform distribution of foam applied to the traveling sheet of yarns.

11 Claims, 10 Drawing Sheets

(51) Int. Cl.
*D06B 5/08* (2006.01)
*D06B 23/02* (2006.01)

(56) References Cited

U.S. PATENT DOCUMENTS

| | | | | |
|---|---|---|---|---|
| 5,009,932 | A | 4/1991 | Klett | |
| 5,145,527 | A | 9/1992 | Clifford | |
| 5,533,445 | A | 7/1996 | Bill | |
| 6,432,202 | B1 * | 8/2002 | Aurich ..... | D06B 1/08 118/411 |
| 2004/0016399 | A1 | 1/2004 | Zeiffer et al. | |
| 2018/0141326 | A1 | 5/2018 | Beck et al. | |

* cited by examiner

DEVICE FOR APPLYING A FOAMED TREATING MATERIAL UNDER PRESSURE TO A TRAVELING SHEET OF TEXTILE YARN

FIELD OF THE INVENTION

The present invention relates to applying foamed treating material under pressure to a traveling sheet of textile yarns, and, more particularly, to preventing unwanted escape of pressurized foamed treating material as the material is being applied to sheet of yarns and preventing transfer of such pressurized foamed treating material between spaces in yarns, and preventing transfer of such pressurized foamed treating material between spaces in yarns in the sheet of yarns.

BACKGROUND OF THE INVENTION

It is common in the textile industry to apply treating material, such as, for example, dye or sizing to sheets of textile material either by transporting the sheets of textile material through a bath or baths containing treating material in liquid form, or, now more preferably, applying the treating material in a foamed form by an applicator or applicators that dispense the foam into or onto the surface or surfaces of the sheets of traveling textile substrate with the foam ultimately breaking down into liquid form. In most instances, applying the treating material in a foamed condition is preferred as it can be controlled to penetrate through the textile substrate or to be deposited only on the surface or surfaces of the textual substrate using one or a plurality of applicators. Most importantly, applying the treating material in the form of a foam has the decided advantage of generating much less wastewater that must be treated and disposed of in comparison with treating material applied in liquid form, such as in a liquid bath.

When foamed treating material under pressure is applied to nonwoven, woven, or knit textile substrate, with resisting pressure applied to the traveling substrate, the resisting pressure compresses the material of the substrate reducing the size of interstices, or spaces, which normally do not extend through the substrate, such that the foamed treating material does not significantly seep through the material being treated and creating waste water.

On the other hand, yarns in a sheet of yarns do not appreciably compress and spacing occurring from separation of yarns and yarn crossovers occurring during travel of the sheet of yarns are pronounced and extend through the sheet from one surface to the other, allowing the foam or resulting liquid to pass directly through the substrate more freely and escape from the substrate, creating increased wastewater, and passing into adjacent spaces, resulting in uneven distribution of the treating material throughout the substrate.

SUMMARY OF THE INVENTION

The present invention provides a different approach to preventing or limiting the escape of unapplied treating material and the seepage of treating material from space to space, thereby limiting undesirable wastewater and uneven distribution of the treating material. Rather than compressing the substrate, which is not of appreciable benefit when treating sheets of non-compressible yarns, the present invention obtains advantageous results by applying a resiliently compressible soft rubber opposing member that itself compresses to seal spaces in the yarns and prevent seepage of treating material between spaces that would otherwise disrupt uniform distribution of the treating material.

In the preferred embodiment, these novel features are accomplished by the present invention by transporting the substrate across an applicator or applicators by drive means, such as a rotating cylindrical roll, that has an exterior layer of impervious, resiliently compressible material positioned against the sheet of yarns as it is transported across the leading nozzle surface, nozzle slot, and trailing surface of the applicator, with the layer, not the yarns, being compressible to cover and bow into spaces in the substrate to form extended sealing contact.

In the preferred embodiment, the drive means is a drive roll with an exterior layer around the drive roll, and the drive roll and exterior layer are tangentially aligned with and extend over the nozzle slot and over a leading surface leading toward and a trailing surface leading away from the nozzle slot. For optimum compression, the exterior layer is preferably vulcanized rubber having a resilience of Shore A 12-60, and the diameter of the surface of the roll exterior layer is approximately 10 times or more than the width of the nozzle slot.

To prevent escape of treating material from the end portions of the nozzle slot that extend beyond the widthwise extent of the sheet of yarns, end seals are preferably mounted in the end portions of the nozzle slot, and the drive roll and resilient exterior layer extend laterally beyond the width of the sheet of yarns and over at least a portion of the end seals.

To maintain the drive roll in optimum position toward the nozzle, adjustable stop means are provided against which the drive roll is positioned at selected spacings from the applicator surfaces, and a pivot mounting of the drive roller is disposed to cause the drive roll to rest against the stop.

To minimize abrasion of the surface of the resilient exterior layer during contact of the layer with the leading and trailing surfaces of the nozzle, a lubricant dispenser is mounted on the device in contact with the surface of the exterior layer. The lubricant dispenser includes an elongated strip of sponge-like wicking material extending along the length of the exterior layer in lubricant dispensing contact with the surfaces of the nozzle.

DETAILED DESCRIPTION OF THE PREFERRED EMBODIMENT

Figure 1:
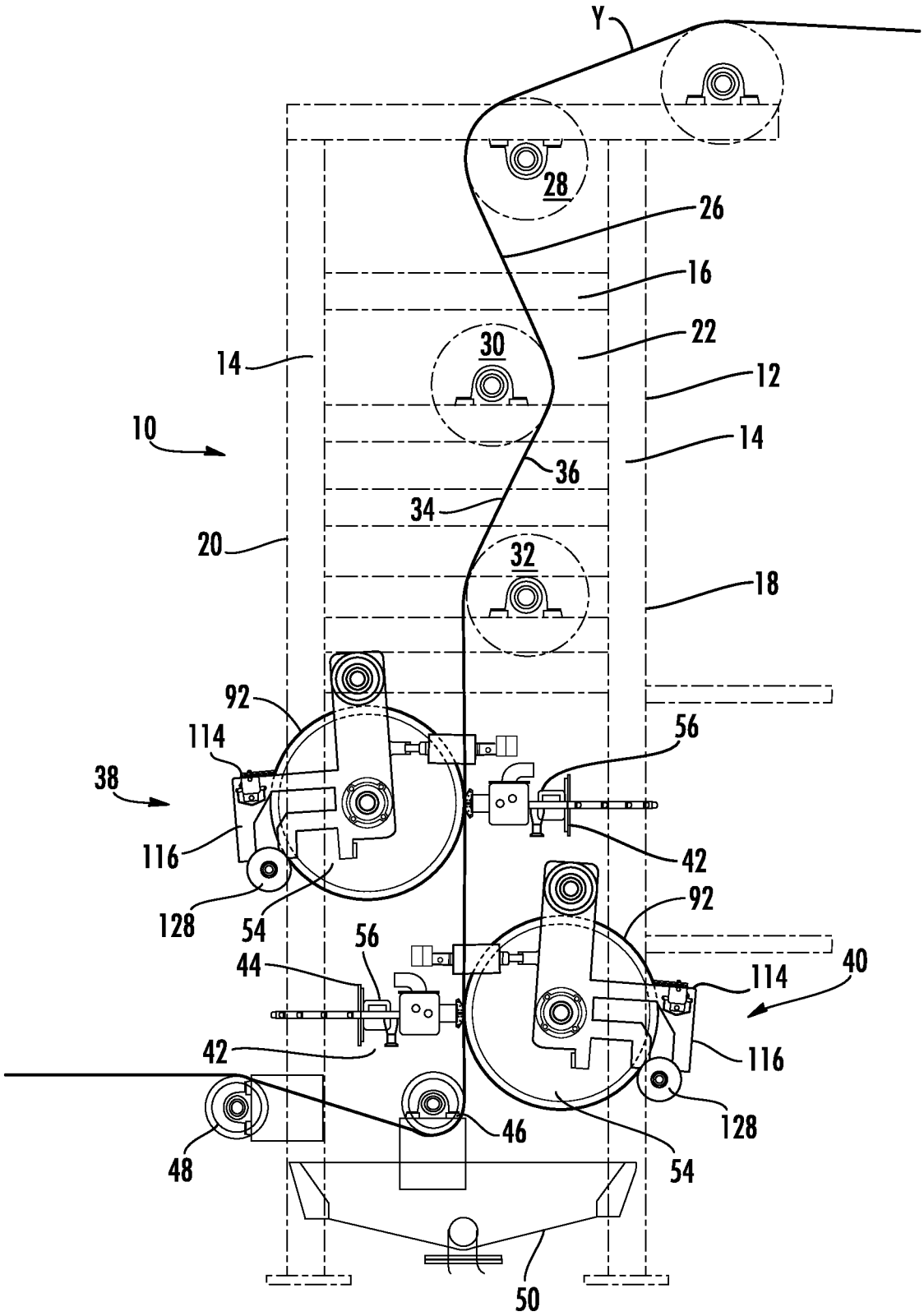
FIG. 1 is a side elevational view of the preferred embodiment of the device of the present invention illustrating the mounting arrangement of the foam applicator units.
Figure 2:
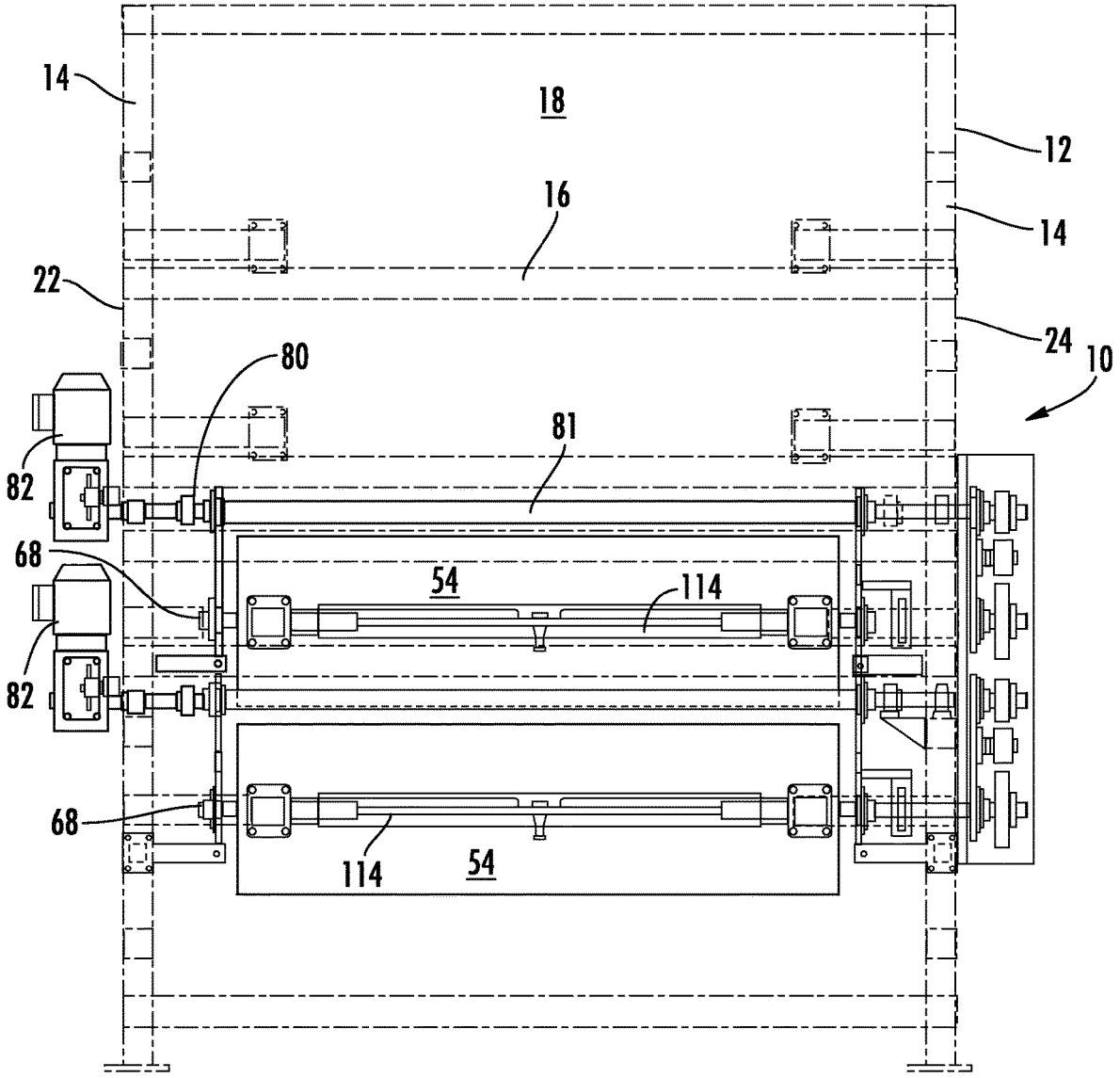
FIG. 2 is a front elevational view of the device of FIG. 1.
Figure 3:
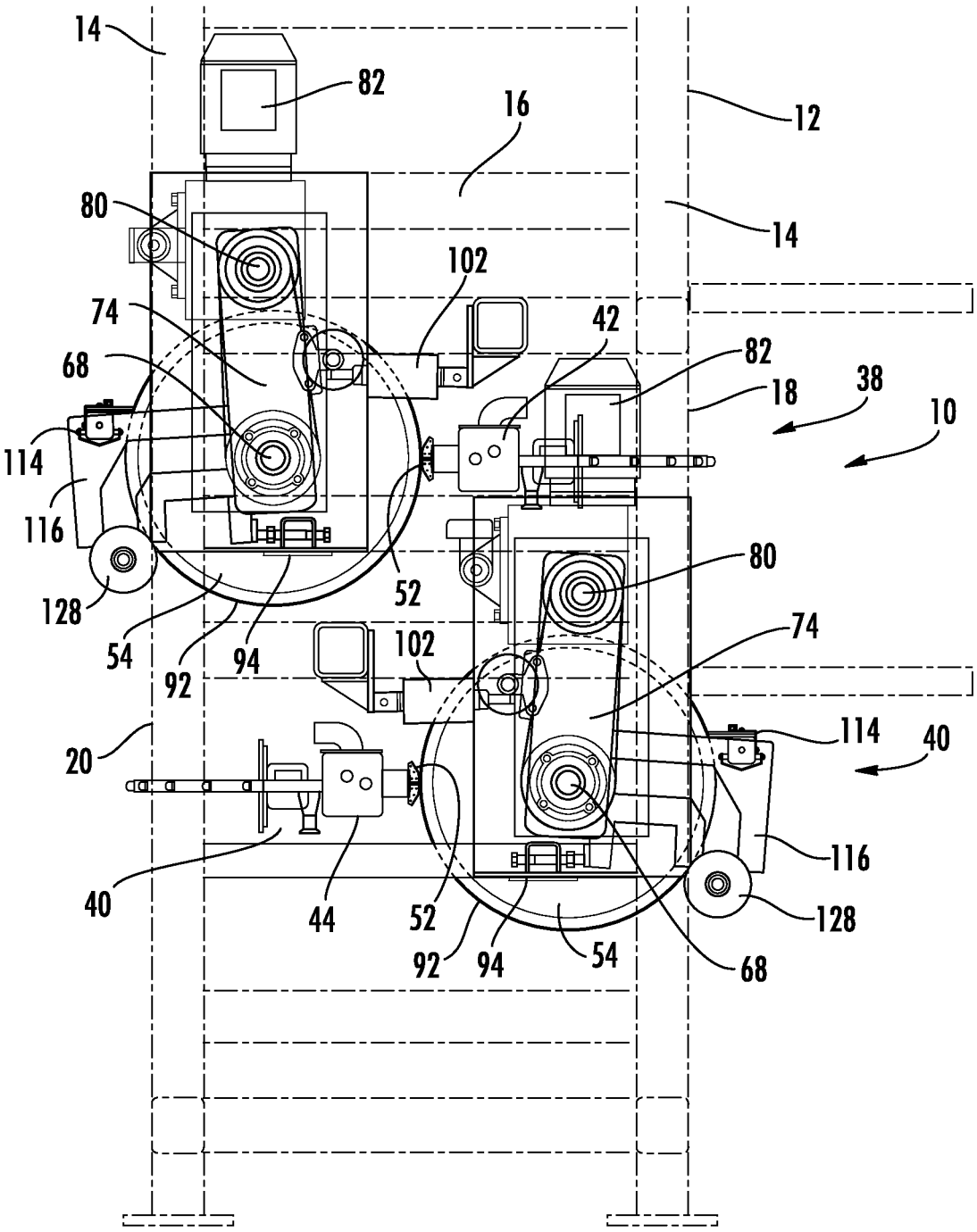
FIG. 3 is an enlarged view of the foam applicator units of FIG. 1 illustrating the drive belts for driving the drive rolls.
Figure 4:
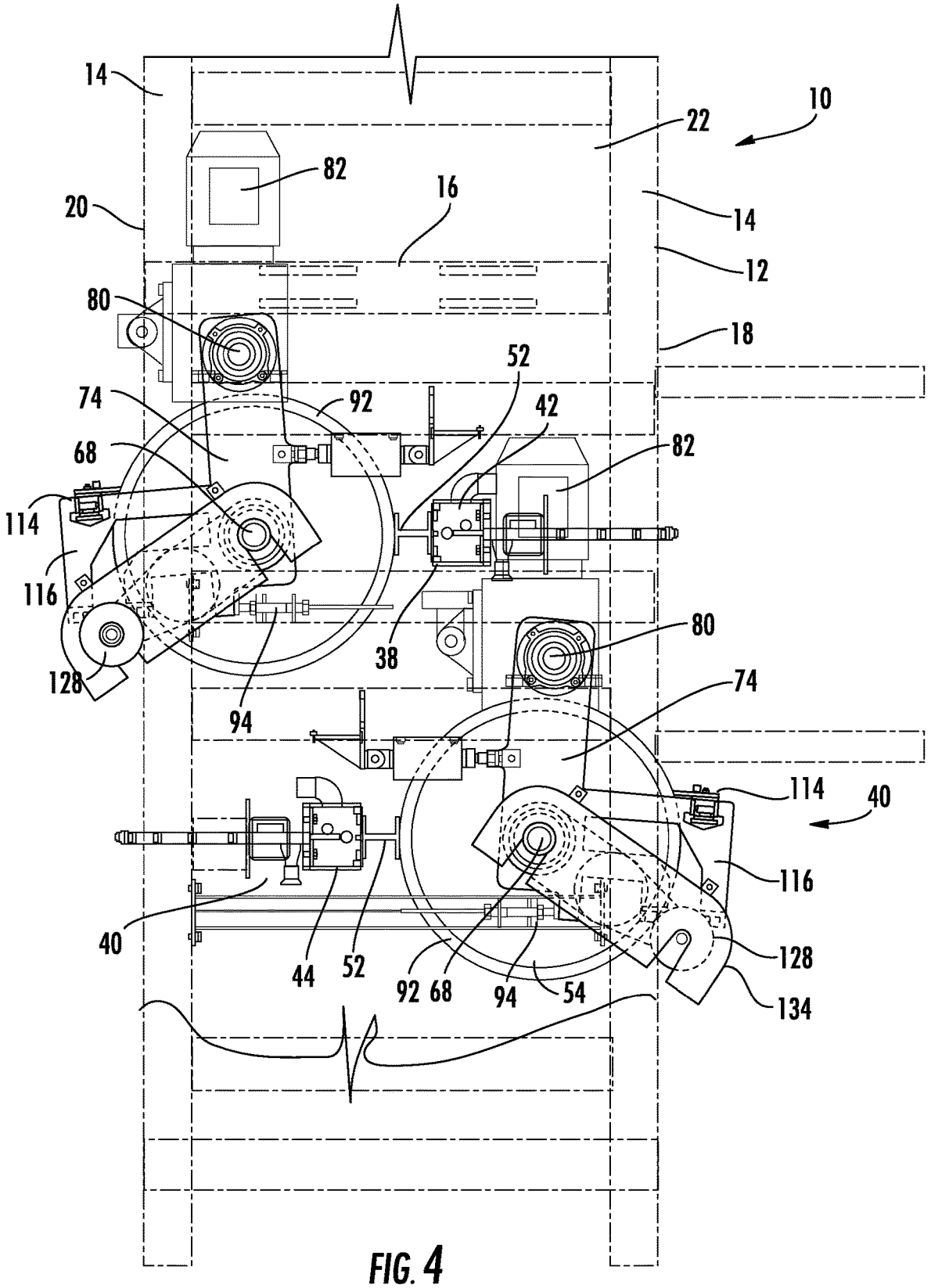
FIG. 4 is a view similar to FIG. 3 adding the mounting and drive connections for the brush rolls.
Figure 5:
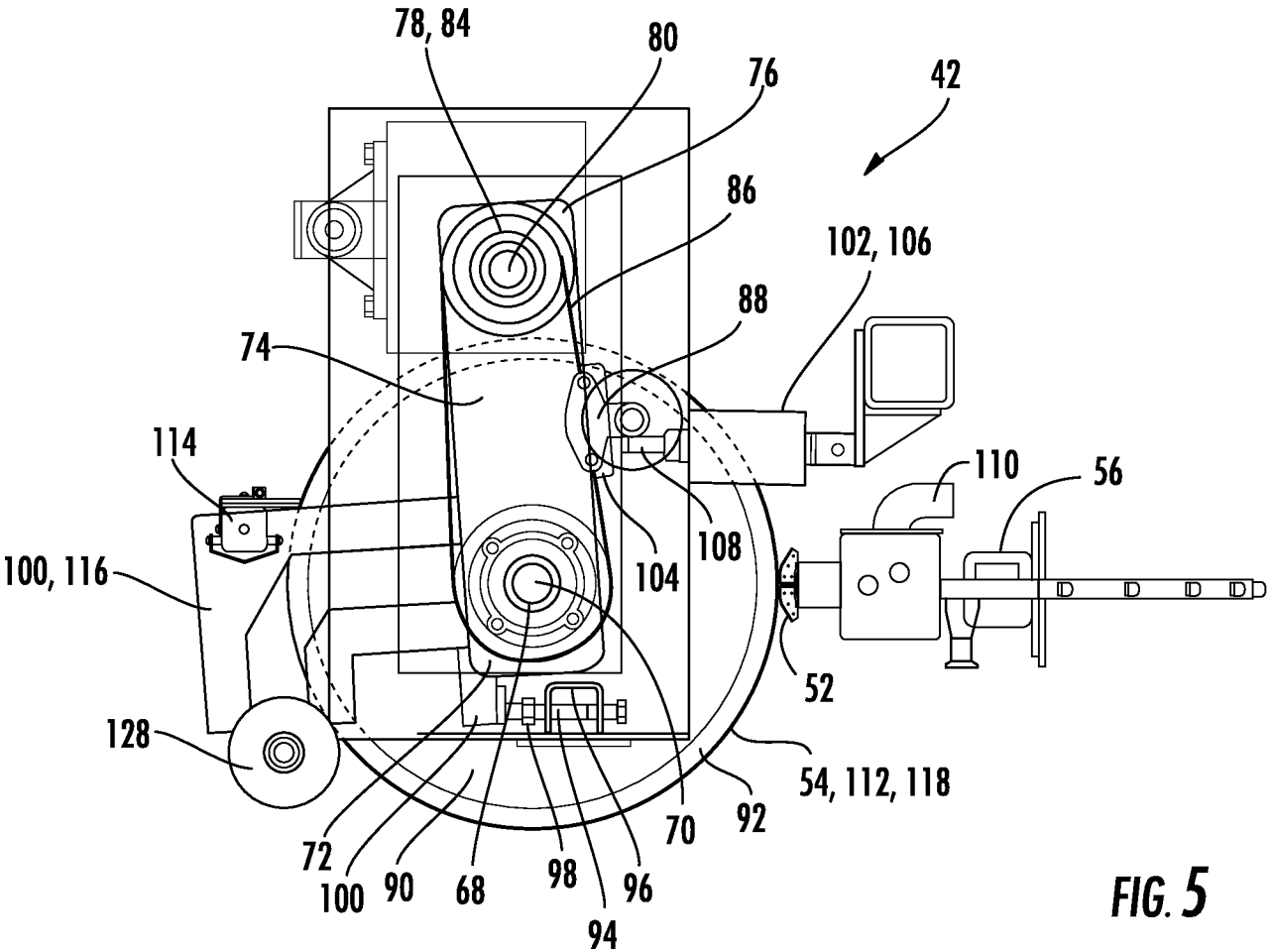
FIG. 5 is an enlargement of the upper foam applicator unit of FIG. 3.
Figure 6:
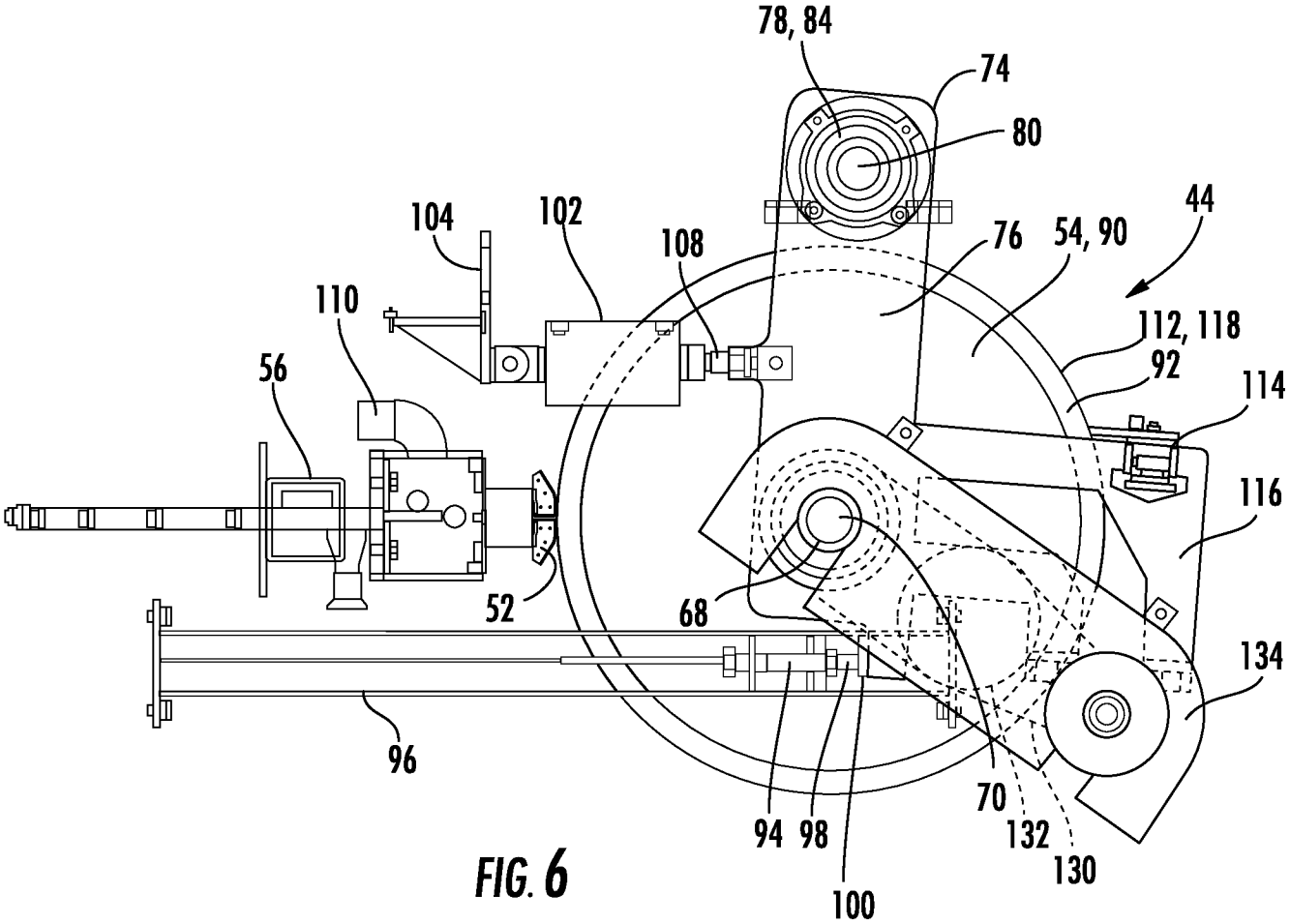
FIG. 6 is an enlargement of the lower foam applicator unit of FIG. 4.

The device 10 of the preferred embodiment of the present invention illustrated in the drawings includes an upstanding frame 12 having vertical corner posts 14 joined by horizontal cross bars 16, thereby defining a front 18, a rear 20, and connecting sides 22, 24. The front 18 and rear 20 are of a widthwise extent greater than the widthwise extent of a sheet S of textile yarns 26 traveling vertically downwardly through the frame 12 generally parallel with and spaced inwardly of the front 18 of the frame.

Mounted on the cross bars 16 in the upper portion of the frame 12 are three vertically spaced rotatable guide rolls 28, 30, 32, aligned with the path of the traveling sheet S of yarns 26. The first and third guide rolls 28 and 32 tangentially engage one side surface 34 of the traveling sheet S of yarns 26. The second guide roll 30 is between the first and third rolls and horizontally offset for engagement with the opposite side surface 36 of the travelling sheet S of yarns 26. This second roll 30 projects slightly into the vertical path of the sheet of yarns to cause a deflection of the sheet of yarns as it travels downwardly, thereby providing sufficient purchase of the sheet S of yarns 26 by the rolls 28, 30, 32 to maintain the integrity of the sheet of yarns 26.

Figure 7:
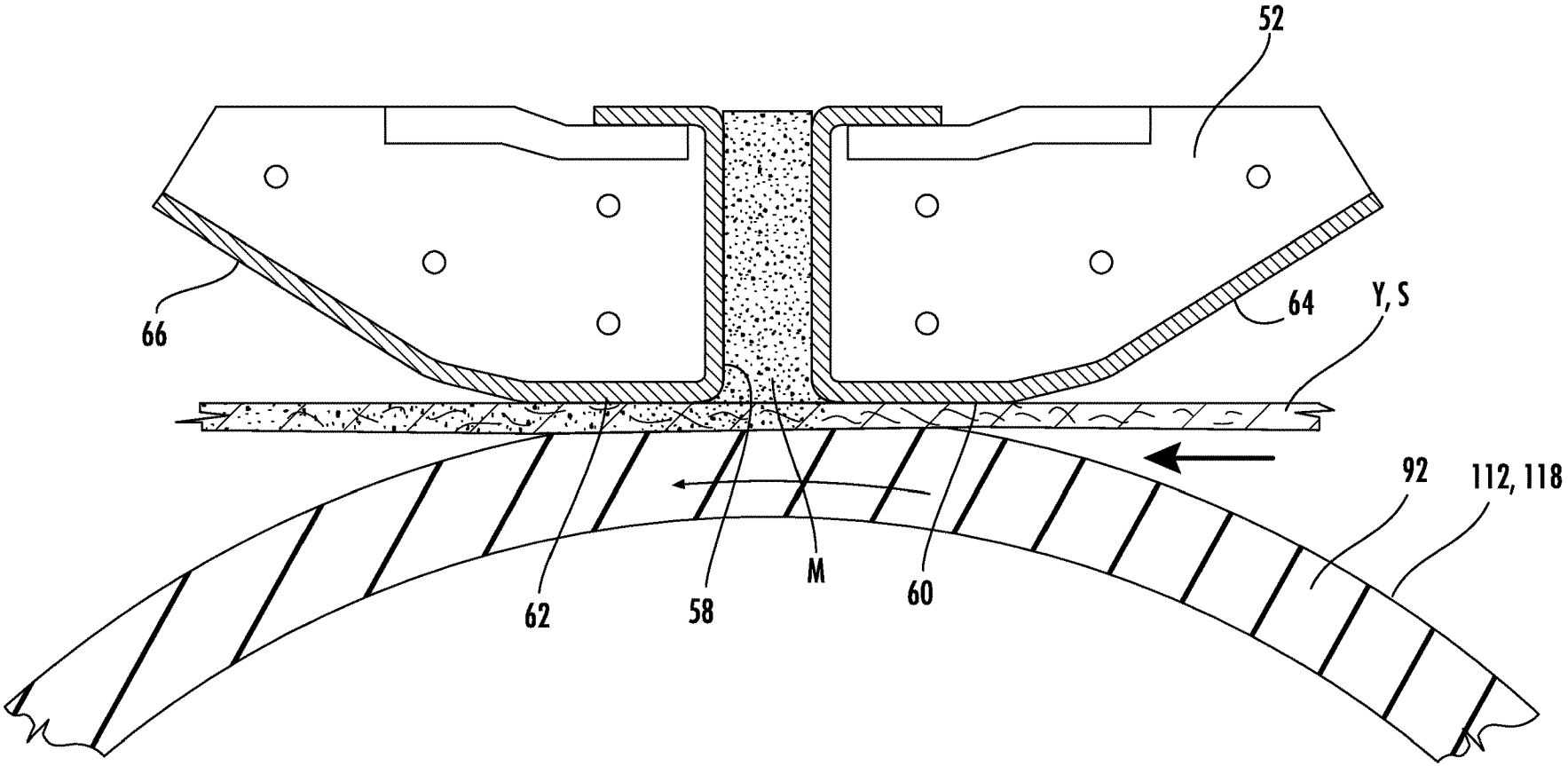
FIG. 7 is an enlarged sectional view of the applicator nozzle slot and adjacent surfaces, and the adjacent portion of the drive roll, of the preferred embodiment, and illustrating a sheet of yarns traveling between the nozzle and the drive roll.

Below the three guide rolls 28, 30, 32 are two vertically spaced foam applicator units 42, 44, one 42 disposed for applying foamed treating material M (FIG. 7) to one side 34 of the sheet S of yarns 26, and the other foam applicator unit 44 being disposed for applying foamed treating material M to the opposite side 36 of the sheet S of yarns 26.

Below the foam applicator units 42, 44 is a bottom guide roll 46 aligned with the traveling sheet S of yarns 26 and disposed for guiding the sheet S of yarns 26 under the bottom guide roll 46 for horizontal travel to a side guide roll 48 over which the sheet S of yarns 26 travels to exit the device for downstream take up or further processing.

At the bottom of the frame 12, below the bottom guide roll 46 is a drain pan 50 disposed for collecting and draining off any condensed foam that may drip from the foam applicator units 38, 40.

Figure 11:
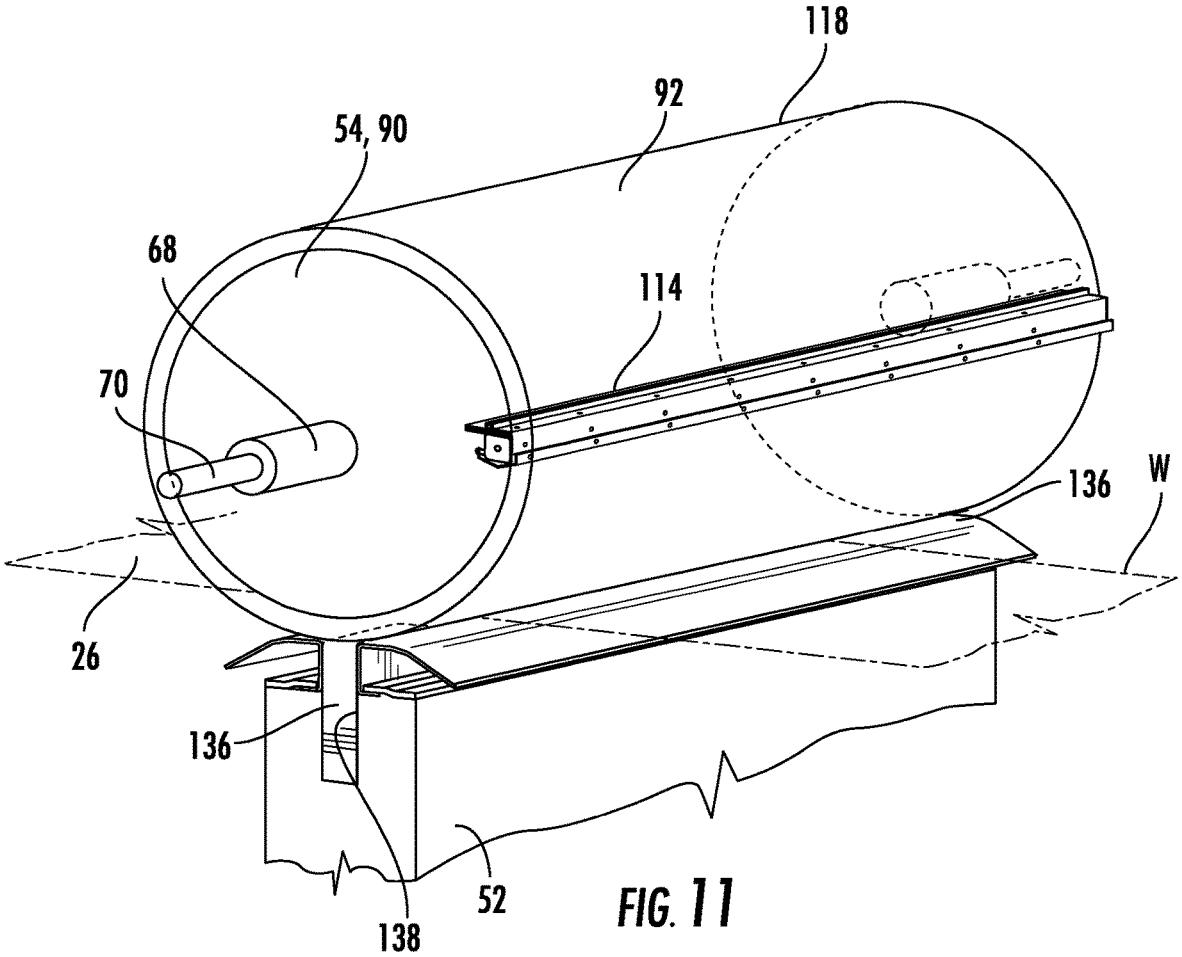
FIG. 11 is a perspective view of the nozzle, drive roll and lubricant dispenser of the preferred embodiment of the present invention.
Figure 12:
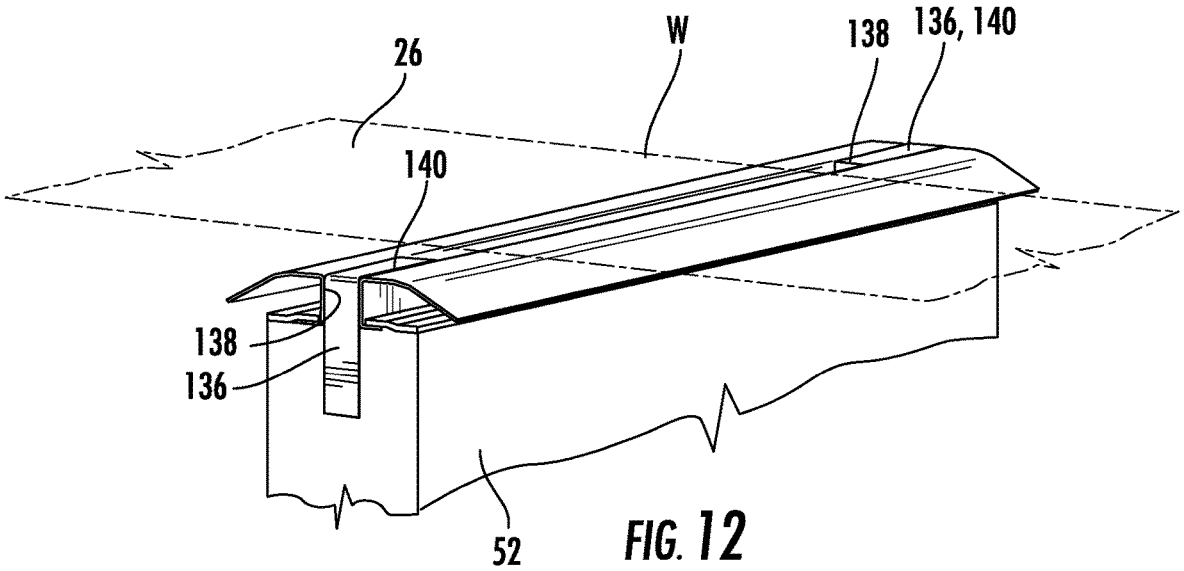
FIG. 12 is an enlarged perspective view of the nozzle and end seals of FIG. 11.

The two spaced foam applicator units 42, 44 are mirror images of each other, each extending along the width of the frame 12 an extent greater than the width W (FIGS. 11 and 12) of the widest sheet of yarn 26 intended to be treated in the device. Each applicator unit 42, 44 includes a foam dispensing nozzle 52 and an opposed drive roll 54 . The nozzle 52 is mounted in a fixed position on a horizontal support 56 attached to and extending between cross bars 16 of the frame 12, and having a foam dispensing nozzle slot 58 facing one side surface 34 of the traveling sheet S of yarns 26, and extending laterally beyond the widthwise extent of the widest sheet of yarn 26 intended to be treated in the device 10. The nozzle 52 has a flat leading surface 60 extending upstream from the nozzle slot 58 parallel with the traveling sheet S of yarns 26 to guide the sheet S of yarns 26 to the nozzle slot 58, and a flat trailing surface 62 extending downstream from the nozzle slot 58 parallel with the traveling sheet S of yarns 26 to guide the sheet of yarns 26 as it travels away from the nozzle slot 58. These leading and trailing surfaces 60, 62 have end portions 64, 66 that flare away from the traveling sheet of yarns 26 to facilitate guiding the sheet of yarns 26 onto and from the nozzle surfaces 60, 62.

Facing the nozzle slot 58 on the opposite side 36 of the traveling sheet S of yarns 26 and parallel with the nozzle slot 58 is the drive roll 54, which is cylindrical with a circular cross-section having a center shaft 68 extending through and beyond ends 70 of the drive roll 54. The ends 70 of the shaft 68 of the drive roll 54 are attached in the lower portions 72 of pivot brackets 74 that have upper portions 76 attached to bushings 78 mounted on the cross bars 16 of the frame 12 to allow pivoting of the pivot brackets 74 and attached drive roll 54. A jack shaft 80 driven by a motor 82 mounted on the frame 12 in a stiffening tube 81 extends across the frame 12 and is mounted in bushings 84. Drive belts 86 connect the driven jack shaft 80 to the center shaft 68 of the drive roll 54 to drive rotation of the drive roll for driving the sheet of yarns 26 across the nozzle surfaces 60, 62 and slot 58. Belt tensioning elements 88 mounted on the pivot brackets 74 engage the drive belts 86 to maintain tension in the drive belts.

The mounting of the pivot brackets 74 and attached elements 88 are disposed so that the drive roll 54 is biased toward the nozzle 52 to rest against the sheet S of yarns 26 traveling therethrough with the tangential peripheral contact of the drive roll 54 with the traveling sheet S of yarns 26 being centered over the nozzle slot 58 and adjacent the leading and trailing surfaces 60, 62 to form a seal confining application of the foam material M to the traveling sheet S of yarns 26 without passage of foam material M between spaces in the traveling sheet of yarns, thereby maintaining uniform distribution of the foamed material M to the traveling yarn sheet 26.

The drive roll 54 is formed with a rigid cylindrical core 90 that is covered by an exterior layer 92 of impervious, resiliently compressible, soft vulcanized rubber material having a hardness, for example, of Shore A 12-60, that extends over the nozzle slot 58 and is compressed against the leading and trailing nozzle surfaces 60, 62 in driving contact with the sheet of yarns 26 therebetween to drive the sheet of yarns 26 through the applicator units 38. To avoid friction between the traveling sheet of yarns 26 and the nozzle surfaces 60, 62 that would resist transport of the sheet of yarns 26 by the rotating drive roll 54, the nozzle surfaces 60, 62 are smooth and relatively non-resistant to travel of the driven sheet of yarns 26.

The compressibility of the relatively soft exterior layer 92 also, importantly, allows the drive roll 54 to be positioned against the sheet S of yarns for sealing engagement of the sheet S of yarns, and with the exterior layer 92 being in direct sealing contact with the nozzle surfaces 60, 62 beyond the widthwise extent of the sheet of yarns 26.

The drive roll 54 is stopped at selected spacings from the nozzle surfaces 60, 62 to control the position of the drive roll 54 with respect to the nozzle surfaces 60, 62 to optimum compression of the drive roll 54 against the nozzle surfaces 60, 62 with the sheet of yarns 26 therebetween by stop mechanisms 94 mounted on a cross bar 96 supported on the frame in position for adjustable stop pins 98 to engage projections 100 at the lower portion 72 of the pivoted bracket 74.

To move the drive roll 54 away from the nozzle 52 to allow access to the space between the drive roll 54 and the nozzle 52 for cleaning, clearing, or repairing in the space between the drive roll 54 and the nozzle 52, piston-cylinder mechanism 102 is attached to a flange 104 depending from a cross bar 16 of the frame 12 above the nozzles 52, with the pistons 106 engaging the pivoted brackets 74 to push the pivoted brackets 74 away from the nozzle 52 by conventional actuation of the mechanisms 102. The connection of the piston-cylinder mechanisms 102 to the flanges 104 are pivot pins 108 to transmit straight line movement of the pistons 106 into arcuate movement of the connected pivot brackets 74 and mounted drive roll 54.

The applicator nozzles 52 are mounted on a cross bar 16 of the frame 12 and include attachment to a source of conventional foam generated yarn treating material, such as sizing, and various textile dyes, including reduced Indigo dye in leuco state (which would require enclosing of the device in an inert atmosphere). The foam is supplied to the nozzles 52 through tubular connections to a multi-parabolic distributor, such as disclosed in Zeiffer et al. U. S Pat. No. 6,814,806, for uniform flow of foam across the nozzle slot 58 at a pressure conventionally controlled by the foam generator. Return of foam, such as when the nozzle 52 is closed and the foamed condition is to be maintained by recirculation, is returned through a return connection 110.

To facilitate smooth non-abrading sliding of the traveling sheet of yarns 26 at a low coefficient of friction across the leading and trailing surfaces 60, 62 of the nozzle 52, a moistening lubricant solution is dispersed onto the surface 112 of the drive roll exterior layer 92 by a lubricant dispenser 114 mounted on tubing 115 extending between laterally extending arms 116 of the pivot brackets 74 at opposite ends of the frame 12. The lubricant dispenser 114 extends across the width of the drive roll 54 to wipe lubricant onto the drive roll surface 118 in advance of rotation of the drive roll 54 to the nozzle 52. A pair of wicking pads 120 of felt or other sponge-like wicking material, supported by an intermediate stiffening sheet 122, is positioned in contact with the drive roll exterior layer surface 118 at an angle in the direction of rotation of the drive roll surface 118 to wipe lubricant, that is supplied to the wicking pads 120 through a conduit 124, onto the drive roll surface 118. A drain pan 126 is positioned under the wicking pads 120 to collect any unwiped lubricant that may drip from the lubricant dispenser 114.

To clear any debris that may accumulate on the exterior layer surface 112 of the drive roll as the roll 54 rotates, a rotating brush roll 128 is mounted on and extends between the latterly extending arms 116 of the pivot brackets 74 in brushing contact with the rotating surface 112 of the drive roll 54. The brush roll 128 is driven by a drive belt 130 driven from the ends 70 of the drive roll shaft 68, with a tensioning disc 132 mounted on the pivot arms 116 and extending into the path of the drive belt 130 to maintain tension in the belts. Guard panels 134 are mounted on the latterly extending arms 116 of the pivot brackets 74 in covering relation to the drive belt 130 of the brush roll 128.

Slidable end seals 136 are positioned in end portions 138 of the nozzle slot 58 under the drive roll 54 laterally beyond the width W of the traveling sheet S of yarns, with top surfaces 140 of the end seals 136 being level with the adjacent nozzle surfaces 60, 62. The drive roll 54 and its resilient exterior layer 92 extends laterally beyond the width W of the sheet S of yarns and over at least a portion of the end seals 136, thereby sealing the end portions 138 of the slot 58 to prevent undesirable escape of the foam dyeing material M. These end seals 136 may be laminations of rubber and steel.

The unique use of a soft, compressible, resilient exterior layer 92 provided by the present invention is particularly beneficial when applying foamed treating material M to yarns Y in a traveling sheet S of yarns. Yarns Y in a sheet S of yarns are more rigid and less compressible than composite textile fabrics such as non-wovens or fabrics formed of yarns, such as woven or knitted fabric, which can be compressed to minimize leakage by reducing the size of spaces or interstices in fabric and avoid any spaces extending through the fabric from one side to the other.

Figure 8:
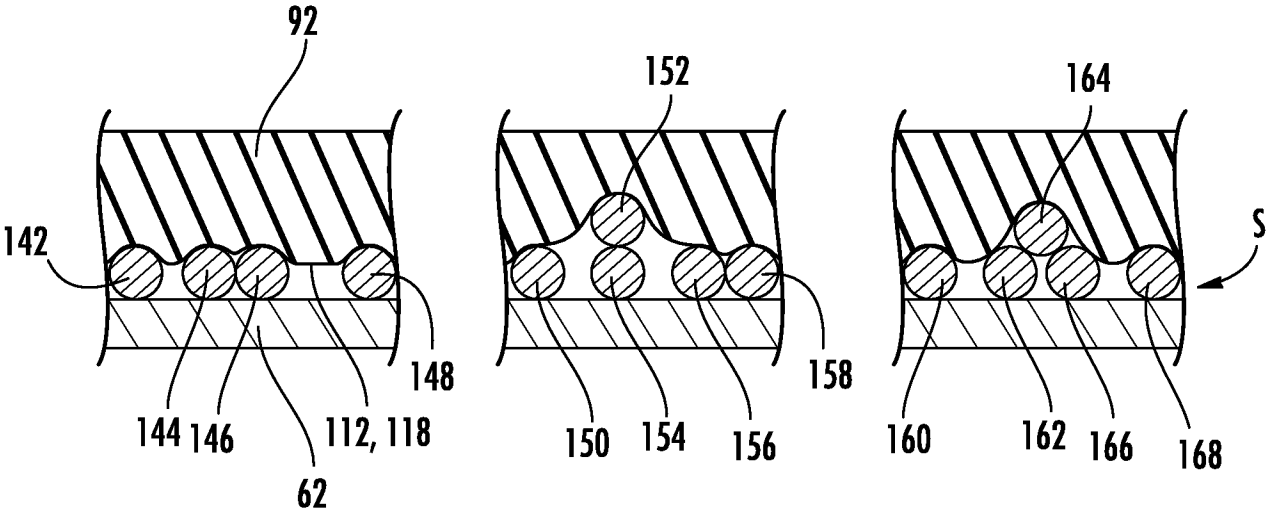
FIG. 8 is an enlarged sectional view illustrating the compression of the surface of the exterior layer of the drive roll to maintain a seal over the sheet of yarns as the yarns travels between the nozzle and the drive roll, and illustrating the compression of the roll surface when the yarns are spaced and when one yarn is crossed over an adjacent yarn during travel of the sheet of yarns.
Figure 9:
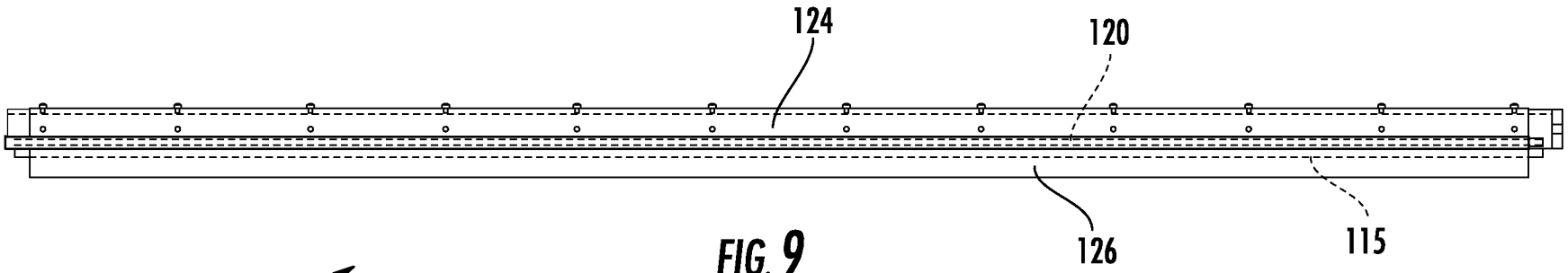
FIG. 9 is front elevational view of the lubricant dispenser of the preferred embodiment of the present invention.
Figure 10:
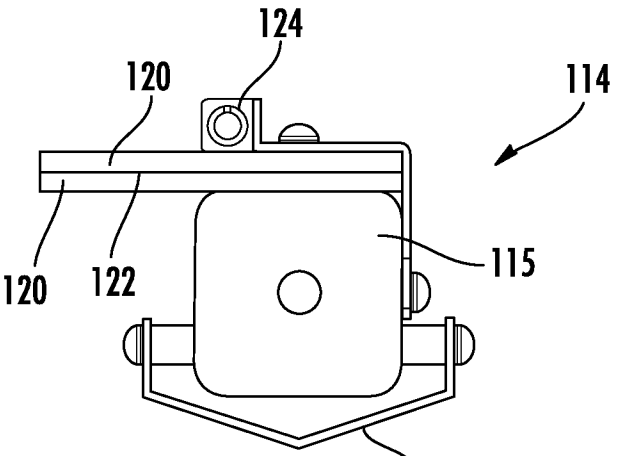
FIG. 10 is a side elevational view of the lubricant dispenser of FIG. 9.

The advantages of applying foamed treating material M to sheets S of yarns provided by the present invention is illustrated in the cross-section drawing of FIG. 8, where the covering of the sheet S of yarns Y by the resilient soft rubber layer 92 provides deformation of the layer 92 into spaces between yarns 26 thereby maintaining the spaces closed to prevent undesirable leakage of treating material and seepage of treating material from space to space. In FIG. 8 the two yarns, 142, 144 at the left are slightly spaced with the covering exterior layer 94 bowing into the space to provide enhanced closure. The third yarn 146 is in contact with the second yarn 144, without any space therebetween. The fourth yarn 148 is spaced from the third yarn 146, creating a space about equivalent to the diameter of a yarn. The fifth yarn 150 is spaced from the sixth and seventh yarns 152, 154, which are stacked in vertical contact, representing a condition where the outer yarn 152 is crossing over the inner yarn 154, leaving spaces on both sides resulting from the crossover outer yarn 152 having left the space between the fifth and sixth yarns 150, 152, and not yet entered into the space between the seventh and eighth yarns 154,156. The ninth yarn 158 is in contact with the eighth yarn 156 without any space therebetween. The depiction of the tenth, eleventh, twelfth, thirteenth, and fourteenth yarns, 160, 162, 164, 166, and 168, illustrate the condition where two yarns 162, 166 are closer together than the diameter of the yarn 164 therebetween, causing the intermediate yarn 164 to ride outward while in contact with the adjacent yarns 162, 166, resulting in spaces between the tenth and eleventh yarns 160, 162, and between the twelfth and fourteenth yarns 166,168. These are representative of possible examples of conditions occurring in applying foam treating material to sheets of yarn. The present invention is applicable as well to various other yarn configurations.

The following demonstrative dimensions and ranges for a typical device made according to the preferred embodiment of the present invention are set out as follows, recognizing that these dimensions and ranges relate to typical preferred embodiments and are not intended to be limitations to the scope of the invention:

Yarn size-0.25 mm.
Yarn per sheet-12,000-13,000
Nozzle slot-0.75" wide, 99" long
Pressure Roll-22" diameter, 105" long
Rubber exterior layer-0.75" thick, 105" long
Jack shaft-5" diameter, 125" long
Brush roll-6" diameter, 99" long
End seals-8" long, 0.75" thick
Surfactant-0.01-1.5% soap in water
Pressure of foam-10-15 lbs. per linear inch
Pressure of roll-2-15 lbs. per linear inches While the present invention has been described in detail in relation to the preferred embodiment, it is to be understood that this disclosure is only illustrative and exemplary of the present invention and is made merely for the purposes of providing a full and enabling disclosure of the invention, with the scope of the invention being limited only by the scope of the appended claims.

What is claimed is:

1. A device for applying a foamed treating material under pressure to a traveling sheet of textile yarns in which spaces occur between yarns due to separation of yarns or cross-over of yarns, comprising:

a foam applicator unit having a nozzle with a nozzle slot disposed for travel of the traveling sheet of textile yarns thereover for application of foamed treating material under pressure to one side of said traveling sheet of textile yarns;

said nozzle having a smooth flat leading surface parallel with the direction of travel of said sheet of yarns for supporting and guiding said sheet of yarns as it travels to said nozzle slot, and a smooth flat trailing surface for guiding said sheet of yarns as it travels away from said nozzle slot;

drive means having an exterior layer of resiliently compressible impervious material positioned against the opposite side of said sheet of yarns for driving said sheet of yarns across said nozzle leading surface, said nozzle slot, and said nozzle trailing surface;

drive means also having a drive roll with said exterior layer tangentially aligned with said nozzle slot and extending over said nozzle slot and over said leading and trailing surfaces;

said resiliently compressible exterior layer being resiliently compressed against said traveling sheet of yarns as said traveling sheet of yarns is driven across said nozzle leading and trailing surfaces to form seals preventing escape of said pressurized foam material in advance of and following travel of said sheet of yarns across said nozzle slot, and preventing flow of pressurized foamed material between spaces in said traveling sheet of yarns, to maintain even distribution of said pressurized foamed treating material to said traveling sheet of yarns.

2. A device for applying a foamed treating material under pressure to a traveling sheet of textile yarns according to claim 1, and characterized further in that the diameter of said roll exterior layer is at least approximately 10 times or more than the width of said nozzle slot to assure sealing of said exterior layer against the traveling sheet of yarns before and after travel of said sheet of yarns across said nozzle slot.

3. A device for applying a foamed treating material under pressure to a traveling sheet of textile yarns according to claim 1, and characterized further in that said nozzle slot has end portions extending beyond the widthwise extent of said sheet of yarns, end seals in said end portions, and said drive roll and said resilient exterior layer extend laterally beyond the width of said sheet of yarns and over at least a portion of said end seals to prevent escape of foamed treating material therepast.

4. A device for applying a foamed treating material under pressure to a traveling sheet of textile yarns according to claim 1, and characterized further by means for positioned said drive roll at selected positions with respect to said nozzle.

5. A device for applying a foamed treating material under pressure to a traveling sheet of textile yarn according to claim 4, and characterized further in that said means for positioning said drive roll comprises stop means against which said drive roll is positioned with respect to said nozzle surfaces.

6. A device for applying a foamed treating material under pressure to a traveling sheet of textile yarns according to claim 5, and characterized further in that said stop means is adjustable to provide selected positioning of said drive roll with respect to said nozzle surfaces.

7. A device for applying a foamed treating material under pressure to a traveling sheet of textile yarns according to claim 5, and characterized further in that said means for positioning said drive roll biases said drive roll against said stop means.

8. A device for applying a foamed treating material under pressure to a traveling sheet of textile yarns according to claim 7, and characterized further in that said means for positioning said drive roll comprises a pivot mounting of said drive roll disposed to cause said drive roll to rest against said stop means.

9. A device for applying a foamed treating material under pressure to a traveling sheet of textile yarns according to claim 1, and characterized further in that a lubricant dispenser is mounted on the device in contact with the surface of said exterior layer to apply lubricant to the surface of said layer to minimize abrasion of said resilient exterior layer during contact of said layer with said leading and trailing nozzle surfaces.

10. A device for applying a foamed treating material under pressure to a traveling sheet of textile yarns according to claim 9, and characterized further in that said means for applying lubricant comprises an elongated strip of sponge-like wicking pads extending along the length of said exterior layer of said drive roll in lubricant dispensing contact with said exterior layer.

11. A device for applying a foamed treating material under pressure to a traveling sheet of textile yarns according to claim 1 and characterized further in that said exterior layer is vulcanized rubber having resilient compressibility of Shore A 12-60.

* * * * *